US005129963A

United States Patent [19]

Panchanathan et al.

[11] Patent Number: 5,129,963

[45] Date of Patent: Jul. 14, 1992

[54] RARE EARTH MAGNET ALLOYS WITH EXCELLENT HOT WORKABILITY

[75] Inventors: Viswanathan Panchanathan, Anderson, Ind.; Teruo Watanabe, Aichi, Japan; Yasuaki Kasai, Nagoya, Japan; Norio Yoshikawa, Nagoya, Japan; Yutaka Yoshida, Tokai, Japan

[73] Assignee: General Motors Corporation, Detroit, Mich.

[21] Appl. No.: 674,257

[22] Filed: Mar. 25, 1991

[30] Foreign Application Priority Data

May 16, 1990 [JP] Japan ..... 2-126246

[51] Int. Cl.[5] ..... H01F 1/02

[52] U.S. Cl. ..... 148/101; 148/104; 419/12

[58] Field of Search ..... 148/101, 102, 103, 104; 419/12

[56] References Cited

U.S. PATENT DOCUMENTS 4,765,848 8/1988 Mohri et al. ..... 148/302
4,801,340 1/1989 Inoue et al. ..... 148/103
4,895,607 1/1990 Yang et al. ..... 148/104

FOREIGN PATENT DOCUMENTS 62-276803 12/1987 Japan ..... 148/101
63-119204 5/1988 Japan ..... 148/101
63-213317 9/1988 Japan ..... 148/101
63-213318 9/1988 Japan ..... 148/101
63-213321 9/1988 Japan ..... 148/101
63-213322 9/1988 Japan ..... 148/101
63-213323 9/1988 Japan ..... 148/101
63-286514 11/1988 Japan ..... 148/101
63-286515 11/1988 Japan ..... 148/101
63-286516 11/1988 Japan ..... 148/101
2206241 12/1988 United Kingdom ..... 148/101

*Primary Examiner*—John P. Sheehan
*Attorney, Agent, or Firm*—George A. Grove

[57] ABSTRACT

The ability to hot work RE-Fe-B type compositions to form anisotropic magnets containing $Nd_2Fe_{14}B_1$-type crystal grains is improved by the addition of suitable, small amounts of one or more of cerium, lanthanum or yttrium. The improvement in hot working is seen in the reduction of cracks in the deformed body and in the ability to reduce the hot working temperature without a significant penalty in magnetic properties.

4 Claims, 1 Drawing Sheet

RARE EARTH MAGNET ALLOYS WITH EXCELLENT HOT WORKABILITY

This invention pertains to the practice of hot working rare earth magnet alloys of the type RE-Fe-B where RE is neodymium and/or praseodymium and optionally one or more other rare earth elements. More particularly, this invention relates to the hot working of such alloys that are provided with one or more additives employed to improve the workability of the material.

BACKGROUND

RE-Fe-B type magnet alloys have recently been developed as materials for permanent magnets with comparatively low cost and with significantly high magnetic properties. Isotropic magnets of this type can be made into various types of anisotropic magnets, i.e., axial, radial and planar anisotropic magnets, by hot plastic working which induces crystallographic alignment. In the production of these magnets, several techniques are employed: (a) rapidly solidifying RE-Fe-B type alloy melt to obtain amorphous or fine crystalline powder followed by hot compacting/pressing and plastic deforming, (b) hot plastic deforming of suitable cast alloys, and other appropriate methods.

However, because of relatively poor hot workability of some RE-Fe-B alloys, cracks were generated during hot working of the alloys. This is the reason why higher degrees of deformation have not been utilized in actual production practices although it would be expected that higher magnetic properties could be obtained at higher degrees of deformation. When such high levels of deformation were applied, cracking was so severe that sound products could not be obtained in some cases.

In addition, hot working is usually conducted at temperatures not lower than about 750° C. to 800° C. so as to induce sufficient anisotropy and hence higher remanence. At such high temperatures, fine crystalline grains obtained by rapid quenching grow coarse, which results in a decrease of intrinsic coercivity. Shorter die life has also been a problem at such temperatures.

Some applicants of the present application previously proposed a method of working which was characterized by the application of appropriate hydrostatic pressure on a free surface of the material in order to cope with the above-mentioned problems during backward extrusion for manufacturing radially oriented magnets (Japanese patent application no. TOKUGAN HEI 1-293873). However, a complicated apparatus is necessary to practice the proposed method, and this leads to higher production costs. Furthermore, in inducing axial magnetic anisotropy by upsetting, it is difficult to avoid the generation and growth of cracks by such method.

An object of the present invention is, therefore, to provide various compositions of rare earth magnet alloys endowed with excellent hot workability. Such improved workability is seen in a marked reduction in the tendency of the material to crack during hot working and in a reduction in the required hot working temperature. The present inventors have processed and evaluated various rare earth magnet alloys in order to improve the hot workability of these alloys. Alloys with certain compositions have been found to have much improved hot workability.

BRIEF SUMMARY

Rare earth magnet alloys of the present invention consist essentially of the following chemical compositions expressed in atomic proportions which include inevitable impurities such as oxygen, nitrogen and hydrogen and may include small amounts of other elements not adversely affecting the objects of this invention:

$$(R_{1-x}LR_x)_a(Fe_{1-z}Co_z)_{100-a-b}B_b$$

where

R is either one or both of Nd and Pr plus small residual amounts of other rare earth elements;

LR is one or two or more rare earth elements taken from the group consisting of Ce, La and Y; and $x=0.005-0.4$, $z=0-0.3$, $a=10-16$ and $b=3-10$.

The other rare earth magnet alloy system of the present invention consists essentially of the following chemical composition expressed in atomic fractions which include inevitable impurities and small amounts of other elements not adversely affecting the objects of this invention:

$$(R_{1-x-y}LR_xHR_y)_a(Fe_{1-z}Co_z)_{100-a-b}B_b$$

where

R, LR, x, z, a and b are specified above;

HR is one or two or more rare earth elements taken from the group consisting of Dy, Gd, Sm, Yb, Tb and Ho; and $y=0.005-0.2$, but $x+y<0.4$.

By adding the element HR, other properties essential to a magnet, e.g., intrinsic magnetic coercivity, can be improved.

In the chemical composition formulae explained above, R, Fe and B are the elements essential to form $R_2Fe_{14}B$ ferromagnetic phase which has high saturation magnetization, a high Curie temperature and a high anisotropy constant and, therefore, Nd and Pr are mainly used as R for the melt-spinning technique and for the casting technique, respectively. Co can be used as a substitute for a part of the Fe (not greater than 30 atomic percent of the total of Fe+Co; $z=0-0.3$) in order to improve the heat resistance of magnet alloys, but it is not necessary in some applications LR elements (Ce, La and Y) in the composition formulae explained above are the elements to be added for improvement of hot workability. Cerium is the preferred additive. Although some mechanisms have been proposed for the improved deformation behavior of the subject compositions, for example, sliding of crystal grains through the grain boundaries, deformation of grains themselves, etc., none of them has been confirmed. However, it has been confirmed that these additive elements are effective in retarding crack generation and growth during working, and in obtaining easier plastic flow which enhances the degree of alignment. This leads to capabilities of higher degrees of deformation and of working at lower temperatures. Furthermore, in the compaction process prior to the working process, which is substantially the process of producing isotropic magnets by itself, the LR addition is found to improve compactability.

The effective additive content (x) of LR substituting R is not smaller than about 0 5 atomic percent of total R+LR and its upper limit is suitably about 40 atomic percent because excessive substitution causes the decrease of coercivity and Curie temperature. More preferably, the LR content should be in the range of about 2 to 20 atomic percent of the total of R+LR.

HR expressed in the above composition formulae is to be added to the elements R, LR, Fe (+Co) and B in order to improve other properties essential to a magnet such as coercivity and maximum energy product HR elements are added as substitution elements for a part of R (+LR). Since excessive substitution causes the decrease of magnetic properties, it is preferred that the range of substitution ratio of HR elements (y) for R is determined to be 0.5 to 20 atomic percent of the total of R+LR+HR and more preferably to be 2 to 20 atomic percent.

In addition, the ranges of atomic fraction (a) of (R+LR), (100-a-b) of (Fe+Co) and (b) of B which give the fundamental compositions of these rare earth magnet alloys are determined as in the composition formulae expressed above so as to form the aforementioned ferromagnetic 2-14-1 tetragonal compound In the manufacturing of magnets from the alloys of the present invention, well known techniques are suitable; for example, the alloys are first processed into powder, the powder is pressed into compacts, and finally the compacts are hot worked into magnets by a suitable method of hot deformation With respect to the manufacture of powder, several well known techniques, i.e., rapid quenching of molten alloys, atomizing, mechanical alloying, mechanical crushing or hydrogen decrepitation, are suitable. As for the hot compaction method of the powder, hot pressing, hot isostatic pressing, liquid dynamic compaction (LDC), extrusion, sintering or casting can be applied.

With respect to the hot working process, well known techniques such as upsetting, extrusion, HIP (hot isostatic pressing), rolling, drawing, ring rolling or rotary forging can be applied in order to produce anisotropic magnets. The magnetic alloys of the present invention exhibit excellent hot workability in this process.

Other objects and advantages of our invention will become more apparent from a detailed description thereof which follows Reference will be had to the drawings in which.

DETAILED DESCRIPTION OF THE INVENTION

By showing some examples hereunder of the practice of how to execute the present invention, the invention is further illustrated However, the present invention is not restricted by descriptions of such examples.

EXAMPLE 1

The raw materials were first melted in a vacuum furnace to obtain the following series of alloy compositions:

$$(Nd_{1-x}Ce_x)_{13.5}(Fe_{0.97}Co_{0.03})_{80.5}B_6$$

where x=0, 0.005, 0.05, 0.1, 0.2.

Next, each melt was made into frieble ribbons by the well known melt quenching (also called melt spinning) technique. Each set of ribbon compositions was broken into a powder and hot pressed in vacuo at 750° C. to obtain solid cylinders with nearly theoretical density.

Figure 1:
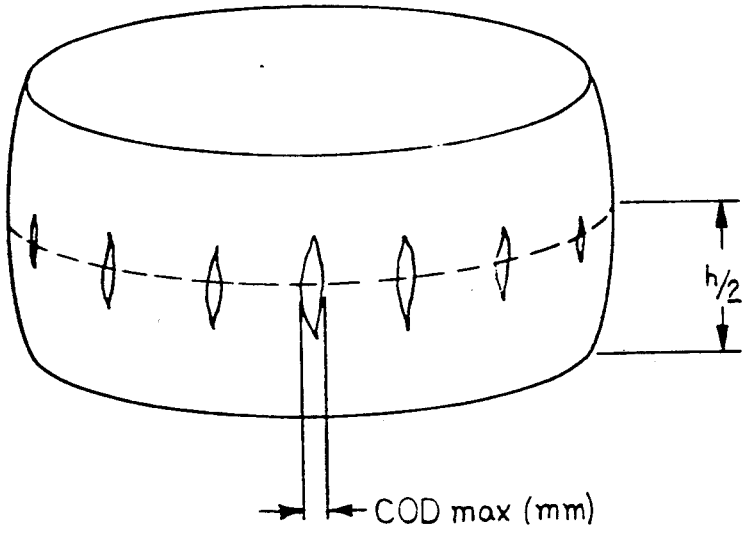
FIG. 1 is a schematic view of an upset specimen having hot working cracks and illustrating the method of measuring Crack Opening Displacement (COD) used in this specification.

Subsequently, the said compact was transferred to a die set with a larger diameter, and it was upset into an axially oriented, barrel-shaped, anisotropic magnet by upper and lower flat punches in an Ar gas environment at 750° C. The degree of deformation, that is, the reduction in height, was 55 percent. At this severe deformation level, cracks were observed in regions of large strain. The largest cracks were at the waist of the barrel extending up and down in the direction of pressing with the widest crack opening midway between the top and bottom of the barrel as illustrated in FIG. 1. The crack width at the half height on the cylindrical surface, named COD hereafter, was measured after upsetting, and the magnetic properties of the upset magnet were measured (Table 1). X=0 means the case without LR addition.

The table shows that Nd substitution by the element Ce appreciably reduces COD in upsetting operation and that substitution up to x=0 2 does not significantly reduce the magnetic properties

TABLE 1

| | x | COD (mm) | Br (kG) | iHc (kOe) | (BH)max (MGOe) |
|---|---|---|---|---|---|
| — | 0 | 1.5 | 12.0 | 13.7 | 34.1 |
| Ce | 0.005 | 0.9 | 12.1 | 13.3 | 34.9 |
| Ce | 0.05 | 0.4 | 12.1 | 12.9 | 35.2 |
| Ce | 0.1 | 0.2 | 12.2 | 12.5 | 35.3 |
| Ce | 0.2 | 0.1 | 12.2 | 12.2 | 35.1 |

Figure 2:
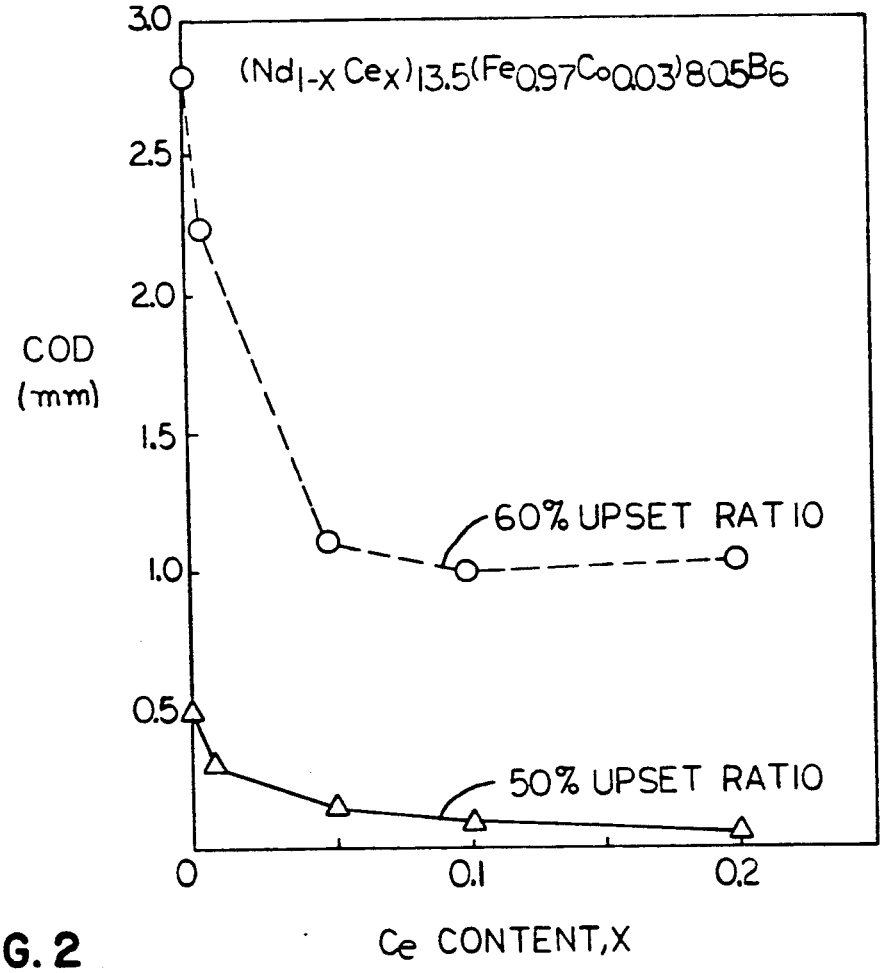
FIG. 2 is a graph for example 1 showing the relationship between the width of the cracks (COD) observed on the cylindrical surface of the specimens and the cerium content of the specimen alloy.

The relationship between COD and Ce amount (x) for two levels of reduction in height, namely, 50 percent and 60 percent, is shown in FIG. 2. It is clearly shown in the figure that the Ce substitution for workability is achieved.

EXAMPLE 2

An experiment like that described in Example 1 was conducted on a melt-spun magnet alloy with the following composition:

$$(Nd_{0.8}Ce_{0.1}Dy_{0.1})_{13.5}(Fe_{0.95}Co_{0.05})_{80.5}B_6$$

The addition of the small amounts of cerium and dysprosium improved the hot workability of the melt-spun composition and upon upsetting to a 55 percent reduction in the height of the cylinder specimen yielded an anisotropic magnet of improved coercivity. The following properties were obtain COD=0.2 mm, Br=12.0 kG, Hc=18.5 kOe and (BH)max=34.1 MGOe.

EXAMPLE 3

A hot working by upsetting experiment like that described in Example 1 was conducted on the magnet alloy (C) with the following composition, and the other alloy (D) was also tested for comparison purposes:

C: $(Nd_{0.95}Ce_{0.05})_{13.5}(Fe_{0.97}Co_{0.03})_{80.5}B_6$

D: $Nd_{13.5}(Fe_{0.97}Co_{0.03})_{80.5}B_6$

The difference from Example 1 is that test was conducted at several upset temperatures, namely, 650° C. to 850° C. The result is listed in Table 2.

TABLE 2

| Alloy | Temperature (°C.) | COD (mm) | Br (kG) | iHc (kOe) | (BH)max (MGOe) |
|---|---|---|---|---|---|
| C | 650 | 1.0 | 11.7 | 14.8 | 33.1 |
| C | 700 | 0.6 | 12.6 | 13.2 | 36.8 |
| C | 750 | 0.4 | 12.1 | 12.9 | 35.2 |
| C | 800 | 0.1 | 11.8 | 8.3 | 26.1 |
| C | 850 | 0.2 | 11.2 | 4.4 | 16.8 |
| D | 650 | Fracture | — | — | — |
| D | 700 | 2.3 | 10.3 | 15.2 | 25.3 |
| D | 750 | 1.5 | 12.0 | 13.7 | 34.1 |
| D | 800 | 0.9 | 12.1 | 10.2 | 34.0 |
| D | 850 | 0.8 | 11.7 | 6.1 | 18.4 |

The table demonstrates that by adding the element cerium, cracking is retarded and magnetic properties in terms of intrinsic magnetic coercivity, remanence and maximum energy product are increased at lower upsetting temperatures.

The above examples illustrate that alloys with compositions described in the present invention effectively reduce the troublesome cracks without sacrificing magnetic properties during compaction of powders and hot working of compacts conducted for the purpose of inducing anisotropy. For this reason, significantly high performance magnets can be manufactured with higher yield.

Thus, our invention is an improvement in the practice of producing hot worked, magnetically anisotropic magnets characterized by a principal phase of tetragonal crystals of the type $RE_2Fe_{14}B$ and a minor portion of an intergranular phase that is typically richer in rare earth than the tetragonal phase. Our invention is particularly suitable where the starting composition is melt spun or otherwise rapidly solidified so that it is initially of an amorphous or very fine grained nature. This material in powder form is suitably hot pressed or precompacted and hot pressed to form a substantially fully dense body that is generally magnetically isotropic or marginally anisotropic. It is then the practice to hot work such a material by one or more of the metal deforming processes described above or the like to form a hot worked body consisting essentially of flattened grains of 2-14-1 phase. The 2-14-1 phase in conjunction with the intergranular phase provides the permanent magnet characteristics of the magnet body. The fact that the hot working has aligned the flattened grains of the 2-14-1 phase means that it has become magnetically anisotropic and has excellent permanent magnet characteristics, especially in the direction perpendicular to the flattened grains. In general, it is preferred that the flattened grains be no larger than about 500 nm on the average in their longest dimension.

As described above, our invention is particularly applicable for compositions that comprise on an atomic percent basis about 10 to 16 percent rare earth elements, 3 to 10 percent boron and about 74 to 87 percent iron plus cobalt We prefer that neodymium and/or praseodymium make up at least about 60 percent of the rare earth content and that iron make up at least 70 percent of the iron plus cobalt content. In accordance with the practice of our invention, we substitute a small but suitable amount of one or more of cerium, lanthanum or yttrium as part of the rare earth content for the purpose of improving the hot workability of the fully densified compact starting material. As described above, this improvement in the ability to hot work the composition is reflected in the ability to sustain greater deformation without crack formation and/or to perform the hot working at a temperature lower than about 750° C. without a substantial loss in permanent magnet properties. For this purpose, we prefer the use of cerium. While the cerium-lanthanum-yttrium addition may be in amounts up to 40 percent of the rare earth content, in most applications we prefer that the content of such additives be less than about 5 to 20 percent of the total rare earth content.

As indicated above, heavier rare earths may also be employed for the purpose of improving coercivity or other selective permanent magnet properties.

While our invention has been described in terms of a few specific embodiments, it will be appreciated that other forms could be adapted within its scope. Accordingly, the scope of our invention is to be limited only by the following claims.

The embodiments of the invention in which an exclusive property or privilege is claimed are defined as follows:

1. In the method of hot working a body compacted from melt-spun powder and of a composition comprising, in atomic percent, 10 to 16 percent rare earth elements (RE), 3 to 10 percent boron and about 74 to 87 percent of iron plus cobalt; where at least 60 percent of the rare earth content is neodymium and/or praseodymium and at least 70 percent of the iron plus cobalt content is iron, to form a magnetically anisotropic permanent magnet consisting essentially of aligned flattened grains of $RE_2Fe_{14}$ tetragonal crystals no larger than about 500 nm on the average in their longest dimension with a minor portion of an intergranular phase, the improvement in which a small amount of an element taken from the group consisting of cerium, lanthanum and yttrium is substituted for up to about 20 percent of the total rare earth content to improve the hot workability of the original body at hot working temperatures below about 750° C.

2. In the method of hot working a body compacted from melt-spun powder and of a composition comprising in atomic percent, 10 to 16 percent rare earth elements (RE), 3 to 10 percent boron and about 74 to 87 percent of iron plus cobalt, where at least 60 percent of the rare earth content is neodymium and/or praseodymium and at least 70 percent of the iron plus cobalt content is iron, to form a magnetically anisotropic permanent magnet consisting essentially of aligned flattened grains of $RE_2Fe_{14}$ tetragonal crystals no larger than about 500 nm on the average in their longest dimension with a minor portion of an intergranular phase, the improvement in which cerium is substituted for up to about 20 percent of the total rare earth content to reduce the hot working temperature below that of a like composition not containing such element and to a temperature below about 750° C.

3. A method as recited in claim 1 wherein a small amount of an element taken from the group consisting of cerium, lanthanum and yttrium is substituted for up to about five percent of the total rare earth content.

4. A method as recited in claim 2 wherein cerium is substituted for up to about five percent of the total rare earth content.

* * * * *